US005289788A

United States Patent [19]

Fukumoto

[11] Patent Number: 5,289,788

[45] Date of Patent: Mar. 1, 1994

[54] METHOD OF CONTROLLING FABRIC EDGE POSITION AND APPARATUS THEREOF

[75] Inventor: Ryosuke Fukumoto, Toyonaka, Japan

[73] Assignee: Yamato Mishin Seizo Kabushiki Kaisha, Osaka, Japan

[21] Appl. No.: 926,180

[22] Filed: Aug. 5, 1992

[30] Foreign Application Priority Data

Sep. 11, 1991 [JP] Japan ..... 3-261121

[51] Int. Cl.[5] ..... D05B 21/00

[52] U.S. Cl. ..... 112/121.12; 112/306; 112/308; 112/318; 112/153; 226/17

[58] Field of Search ..... 112/308, 306, 318, 322, 112/314, 153, 312, 313, 262.3, 320, 121.15, 121.11, 121.12; 226/15, 17

[56] References Cited

U.S. PATENT DOCUMENTS 4,120,254 10/1978 Herr et al. ..... 112/220 X
4,577,573 3/1986 Peloggio ..... 112/318
4,813,364 3/1989 Boser ..... 112/308 X
4,827,856 5/1989 Rohr ..... 112/322 X

FOREIGN PATENT DOCUMENTS 2404468 8/1975 Fed. Rep. of Germany .
3048198 12/1982 Fed. Rep. of Germany .
291362 6/1991 Fed. Rep. of Germany .
291363 6/1991 Fed. Rep. of Germany .
55-145956 11/1980 Japan ..... 226/17

*Primary Examiner*—Peter Nerbun
*Attorney, Agent, or Firm*—Darby & Darby

[57] ABSTRACT

A method and an apparatus for controlling the fabric edge position wherein a fabric fed to the needle location of a sewing machine is fed downstream, feeding distances per unit time at two feeding points, which are along a direction almost perpendicular to the fabric feeding direction, are differentiated by detecting the fabric edge position in the vicinity of the needle location, thereby shifting rightward and leftward the fabric edge position in the vicinity of the needle location so as to form a seam at a constant distance from the fabric edge.

5 Claims, 4 Drawing Sheets

METHOD OF CONTROLLING FABRIC EDGE POSITION AND APPARATUS THEREOF

BACKGROUND OF THE INVENTION

1. Field of the Invention

This invention relates to a method and apparatus employed in a double chainstitch machine used for bottom hemming of a T-shirt, etc., a lock stitch machine or the like, to control the fabric edge position in order to form a seam on a sewn product at a constant distance from a fabric edge.

2. Description of the Related Art

In bottom hemming of a T-shirt, or the like, by utilizing a double chainstitch machine or a lock stitch machine, a missing stitch or far stitch may happen when sewing the T-shirt at an inwardly folded back bottom. In order to prevent the degradation in quality of sewn products due to such a missing stitch or far stitch, the sewing width must be maintained constant to form the seam at a constant distance from the bottom.

Conventionally, in order to appropriately feed the fabric portion where no missing stitch or far stitch is to be produced to the needle location, an operator manually controls the position of a T-shirt fabric, with a folded back bottom, by shifting the fabric to the position where the fabric is able to obtain a fixed sewing width after inserting the fabric beneath the presser foot and puller.

As mentioned above, there are problems associated with the conventional manual positioning of fabric, including that those conventional methods require much labor, thereby lowering the sewing efficiency. Also, the conventional method require the skill of an operator in positioning the fabric thus preventing sewing automation.

SUMMARY OF THE INVENTION

The present invention solves the above-mentioned problems. It is an object of the present invention to provide a method and an apparatus controlling the fabric edge position in order to obtain a constant sewing width by detecting the fabric edge position and differentiating the feeding velocity of the fabric in the feeding direction at two positions of the fabric.

The above further objects and features and advantages of the present invention will become more fully be apparent from the following detailed description especially when taken in conjunction detailed description especially when taken in conjunction with accompanying drawings.

DESCRIPTION OF THE PREFERRED EMBODIMENTS

The present invention will be described with reference to the drawings of the embodiments.

Figure 1:
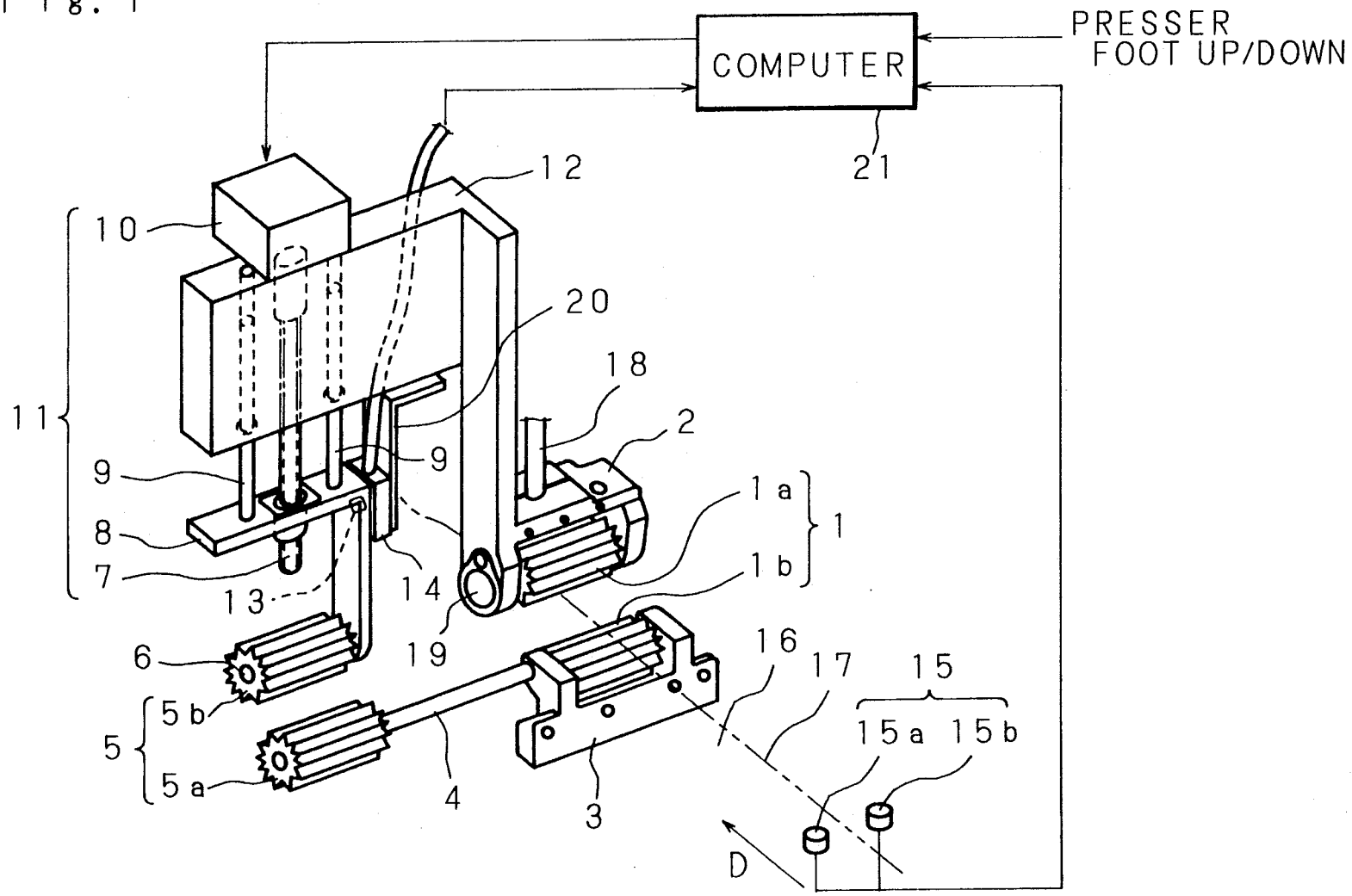
FIG. 1 is a perspective view illustrating the configuration of the apparatus of the present invention.

FIG. 1 is a perspective view illustrating the configuration of an embodiment of the apparatus for controlling the fabric edge position according to present invention (hereinafter, referred to as the apparatus of the invention).

In the FIG. numeral 1 denotes a puller as a first fabric feeding mechanism which is disposed behind the needle location of a sewing machine in the lower stream of the fabric feeding direction, and which transfers fabric in accordance with the rotation of the sewing machine. The puller 1 consists of an upper toothed roller 1*a* which is coupled to the sewing machine through a mechanical clutch so as to rotate in the fabric feeding direction D, and a lower toothed roller 1*b* which engages with the upper roller 1*a* and rotates by following the rotation of the upper roller 1*a*.

The upper roller 1*a* is rotatably mounted to an upper roller yoke 2 through a clutch shaft 19 of a one-way clutch. The upper roller yoke 2 is supported by a holder 12 which falls in accordance with the fall of a presser foot of the sewing machine. An upper roller pressure bar 18 which is connected to an upper roller bracket (not shown) of the sewing machine is inserted into the upper portion of the upper roller yoke 2 approximately at the center.

The lower roller 1*b* is fitted into one end of a rotational shaft 4 which extends in a direction perpendicular to the fabric feeding direction. The lower roller 1*b* is attached, through the rotational shaft 4, to a lower support 3, which is fixed at an adequate position on the far side of the sewing machine bed. A driving roller 5*a* is fitted into the other end of the rotational shaft 4. The driving roller 5*a* rotates in the fabric feeding direction D in accordance with the rotation of the lower roller 1*b* which is transmitted via the rotational shaft 4.

A toothed driven roller 5*b* being rotated by the engagement with the driving roller 5*a*, is disposed above the driving roller 5*a* rotatably in the vertical direction. The driving roller 5*a* and the driven roller 5*b* constitute a second fabric feeding mechanism 5.

The holder 12 has a holding portion in the direction perpendicular to the fabric feeding direction D, which holds a mechanism 11 for adjusting the engaging depth of the driven roller 5*b* with the driving roller 5*a* by moving the driven roller 5*b* up and down.

The engaging depth adjusting mechanism 11 consists of: a step motor 10 which rotates in response to a signal supplied from a computer 21 in accordance with the position of the fabric edge; a ball screw 7 one of which screws on the step motor 10; two slider shafts 9 each one end of which is fixed to the upper leg of a hooked bracket 8 and the each other end of which is slidably fitted into the holding portion of the holder 12 in the vertical direction; and the bracket 8 where each end of the slider shafts 9 is fixed to and the other end of the ball screw screws on the upper leg, and the driven roller 5*b* fitted to a shaft 6 is held at the lower end of a shaft 6.

A magnet 13 is embedded in the bent portion of the bracket 8. A Hall IC 14 is attached to a mounting plate 20 fixed to the holder 12, so as to face the magnet 13.

Furthermore, fabric edge position detecting mechanism 15, consisting of a photosensor left 15*a* and photosensor right 15*b*, is disposed on the near side of the needle location of the sewing machine. The photosensor left 15*a* and photosensor right 15*b* are arranged along a direction perpendicular to the fabric feeding direction D at an adequate distance in a manner that the center of the two photosensors 15*a*, 15*b* is the point necessary for the fabric edge to pass.

The computer 21 supplies to the step motor 10 signals responsive to the inputs from the Hall IC 14, or from the fabric edge position detecting mechanism 15 or responsive to the ascending and descending of the presser foot of the sewing machine.

The operation of the thus configured apparatus of the invention will be described.

When the apparatus is powered on, the driven roller 5b is raised by the ascent of the holder 12 ascended in accordance with the ascent of the presser foot of the sewing machine, and the engaging depth adjusting mechanism 11 moves the driven roller 5b to a reference position detected by the combination of the Hall IC 14 and magnet 13.

After being moved to the reference position, in response to a presser foot descending signal, the driven roller 5b is descended by the holder 12 to a position so as to engage with the driving roller 5a by a reference engaging depth to be described later, still being kept at the reference position.

Thereafter, when the operation of the sewing machine starts, the fabric edge position detecting mechanism 15 consisting of the photosensor left 15a and photosensor right 15b detects the fabric edge 17. The computer 21 calculates the engaging depth of the driven roller 5b with the driving roller 5a. Upon this calculated depth, the engaging depth adjusting mechanism 11 makes the engaging depth of the driven roller 5b with the driving roller 5a deeper or shallower than the reference depth. The variation in the engaging depth changes the catching amount of the fabric 16 by the second fabric feeding mechanism 5, thereby increasing or decreasing the feeding distance of the fabric 16 per a unit time, otherwise known as a feeding velocity.

In synchronism with the descent of the presser foot of the sewing machine, the holder 12 also descends so that the fabric 16 between the upper roller 1a and the lower roller 1b is caught by the rollers 1a, 1b. At the same time, the upper roller 1a is rotated by a driving mechanism such as a motor connected thereto, and the lower roller 1b follows to rotate, thereby feeding the fabric 16 in the fabric feeding direction D.

Figure 2:
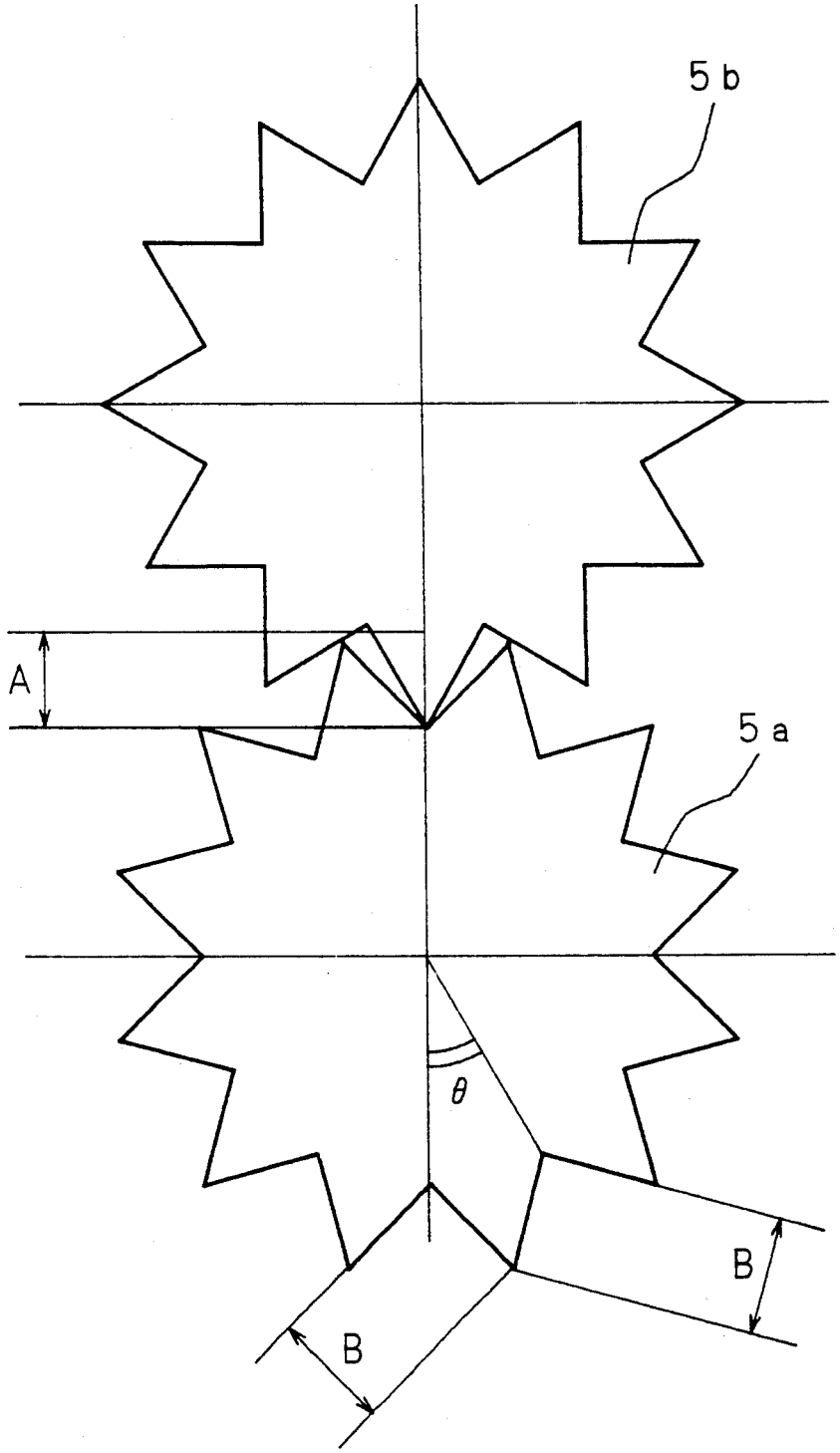
FIGS. 2 and 3 are diagrams illustrating the principle of the method of present invention.
Figure 3:
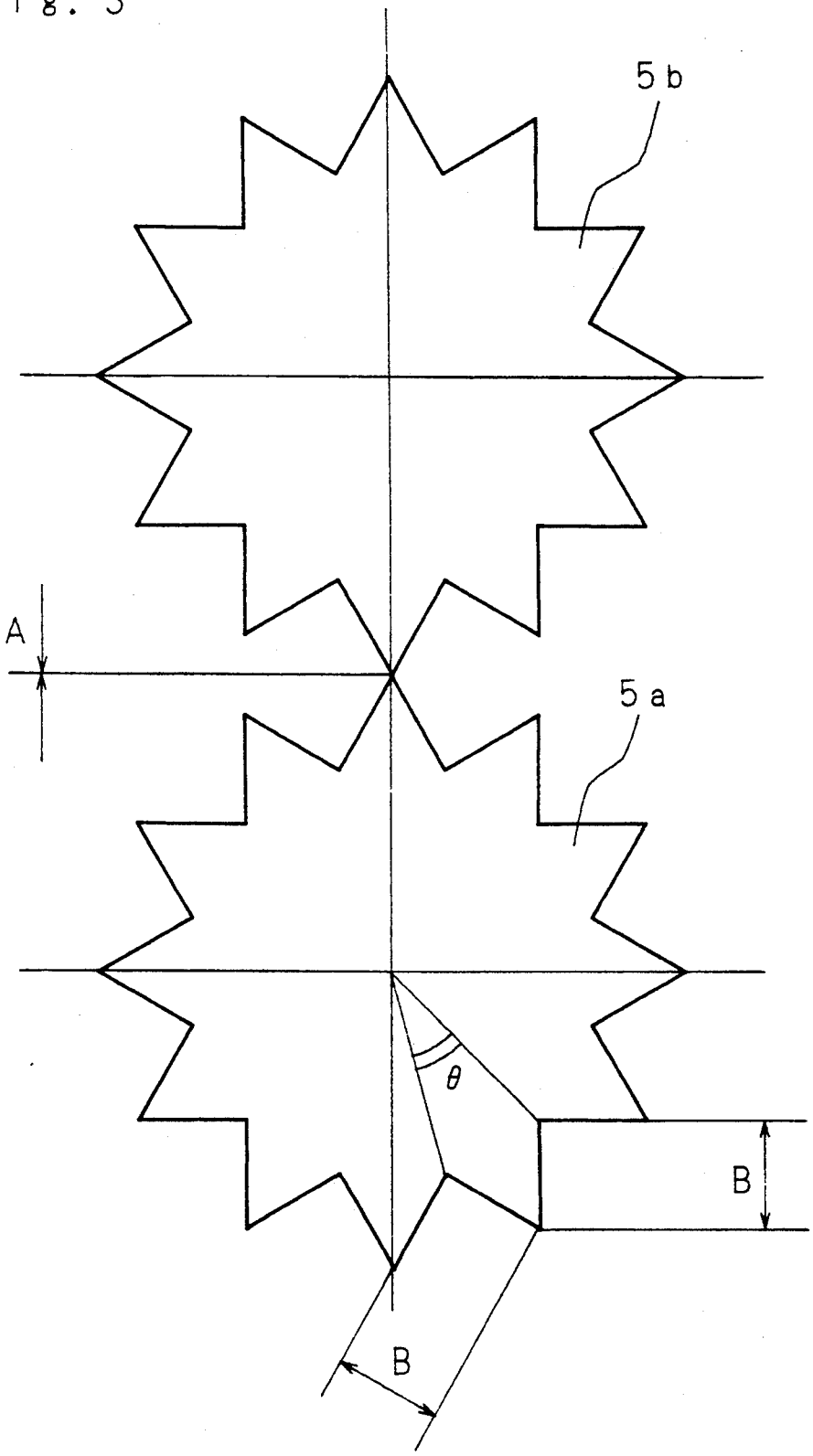

FIGS. 2 and 3 are diagrams explanatory of the variation in the fabric feeding distance in accordance with the engaging depth of the driven roller 5b with the driving roller 5a. FIG. 2 shows the case where the engaging depth A is maximum, and FIG. 3 the case where the engaging depth A is zero.

When the number of teeth of the driving roller 5a is defined by $\theta/360°$ and the height from bottom to top of a tooth flank is indicated by B, the theoretical feeding distance of the fabric 16 neglecting the fabric thickness is $(2\times B\times\theta/360°)$ per one revolution of the driving roller 5a in the case where the engaging depth A is maximum.

In the case where the engaging depth A is zero, the theoretical feeding distance of the fabric 16 neglecting the fabric thickness is zero.

In the embodiment, the regular fabric feeding distance by the puller 1 is set half the maximum distance by engaging the driven roller 5b with the driving roller 5a by half the maximum depth A.

The relationship between the engaging depth A of the driven roller 5b with the driving roller 5a and the fabric feeding distance will be explained hereinafter.

When the engaging depth of the driven roller 5b with the driving roller 5a is deeper than a half of the maximum, the feeding distance of the fabric 16 by the second fabric feeding mechanism 5 is greater than the regular fabric feeding distance by the puller 1. Therefore, the second fabric feeding mechanism 5 catches the fabric 16 more than the puller 1 catches, resulting in that the fabric edge 17 is shifted leftward. When the engaging depth of the driven roller 5b with the driving roller 5a is shallower than a half of the maximum, on the contrary, the feeding distance of the fabric 16 by the second fabric feeding mechanism 5 is smaller than the regular fabric feeding distance by the puller 1. Therefore, the puller 1 catches the fabric 16 more than the second fabric feeding mechanism 5 catches, resulting in that the fabric edge 17 is shifted rightward.

Figure 4:
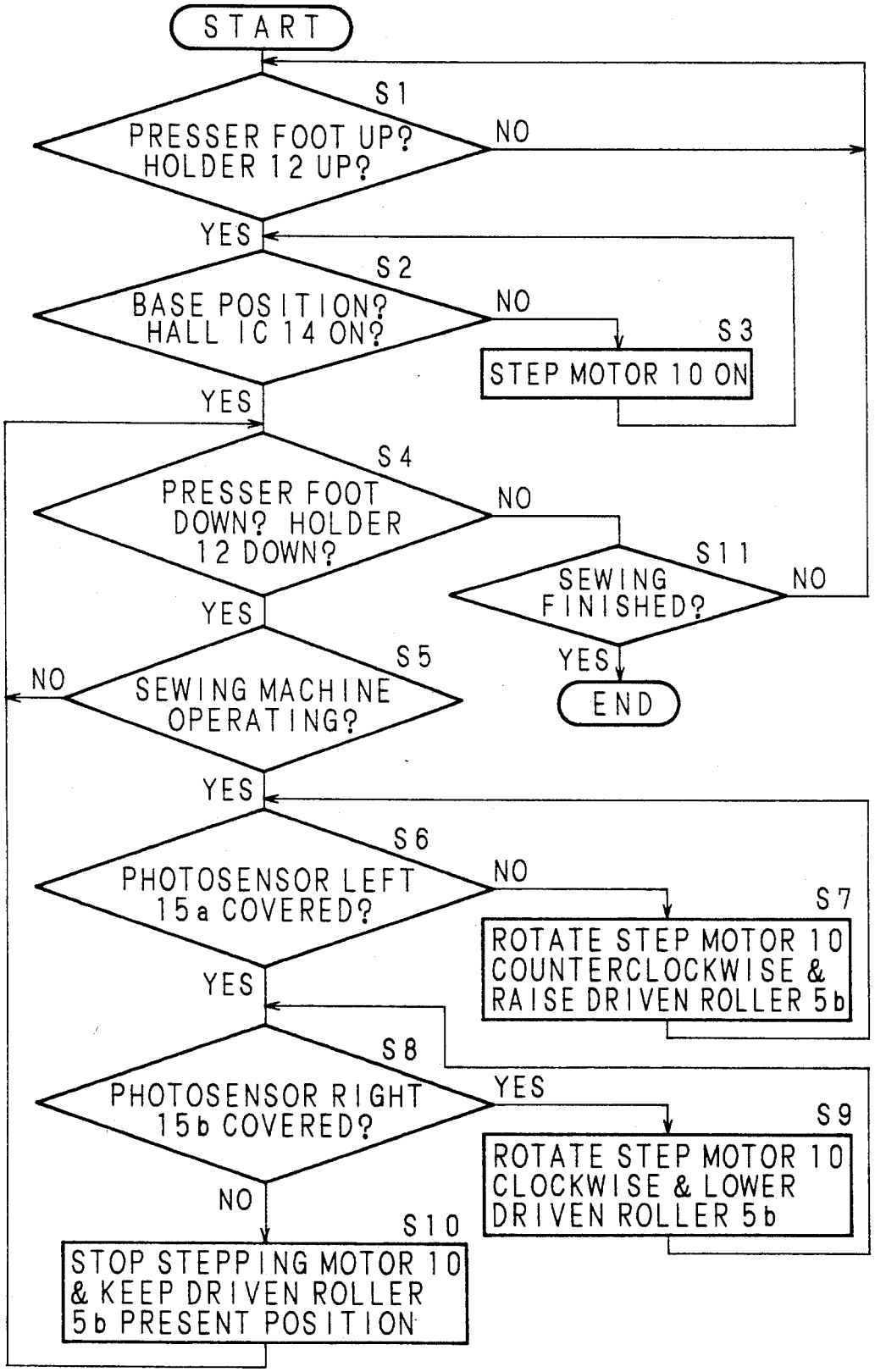
FIG. 4 is a flowchart showing the steps of the method of the present invention.

The procedure of the method of controlling the fabric edge position according to the invention (hereinafter, the method will be referred to as the method of the invention) will be described with reference to the flowchart shown in FIG. 4.

Whether or not the presser foot of the sewing machine ascends is judged by checking whether or not the holder 12 ascends (S1). In the case where the holder 12 ascends, whether or not the driven roller 5b is set at the reference position is judged by checking whether or not the Hall IC 14 is ON (S2). When the Hall IC 14 is not ON, the step motor 10 is powered on to set the driven roller 5b at the reference position relative to the holder 12 until the Hall IC 14 is turned on (S3).

After the driven roller 5b is set at the reference position, whether or not the presser foot descends is judged by checking whether or not the holder 12 descends (S4). In the case where the holder 12 descends, whether or not the sewing machine is in operation is judged (S5). In the case where the sewing machine is not operation, the process waits until the holder 2 descends and also the sewing machine is in operation.

When detecting the operation of the sewing machine occurs, then whether or not the fabric edge 17 covers the photosensor left 15a and photosensor right 15b is judged (S6 and S8). In the case where the fabric edge 17 covers only the photosensor left 15a but not the photosensor right 15b, that is, the fabric edge 17 is properly fed by passing in the middle of the photosensor left 15a and the photosensor right 15b, the step motor 10 is not operated. So that the driven roller 5b is kept in its present position (S10), and the process returns to step 4. In this case, the engaging depth A of the driven roller 5b with the driving roller 5a is not changed.

In the case where the fabric edge 17 does not cover the photosensor left 15a, that is, the fabric edge 17 deviates leftward, the step motor 10 is powered on so as to rotate counterclockwise. In synchronism with this rotation, the ball screw 7 rotates counterclockwise, thereby ascending the driven roller 5b through the slider shafts 9 and the bracket 8 (S7).

As a result, the engaging depth A of the driven roller 5b with the driving roller 5a becomes shallower so that the feeding distance of the fabric 16 by the second fabric feeding mechanism 5 becomes smaller than that by the puller 1. This causes the puller 1 to catch a greater amount of the fabric 16, thereby shifting the fabric edge 17 rightward.

When it is detected that the fabric edge 17 is covering the photosensor left 15a, then whether or not the fabric edge 17 still covers the photosensor right 15b is judged (S8). When the fabric edge 17 no longer covers the photosensor right 15b, that is, when the fabric edge 17 is in between the photosensor left 15a and the photosensor right 15b, the step motor 10 is stopped so as to stop ascending the driven roller 5b, and the present condition is maintained (S10). The process then returns to step 4.

In the case where the fabric edge 17 covers the photosensor left 15*a*, then whether or not the fabric edge covers the photosensor right 15*b* is judged (S18). When the fabric edge 17 covers the photosensor right 15*b*, i.e., the fabric edge 17 deviates rightward, the step motor 10 is powered on so as to rotate clockwise. In synchronism with this rotation, the ball screw 7 rotates clockwise, thereby descending the driven roller 5*b* through the slider shafts 9 and the bracket 8 (S9).

As a result, the engaging depth A of the driven roller 5*b* with the driving roller 5*a* becomes deeper so that the feeding distance of the fabric 16 by the second fabric feeding mechanism 5 becomes greater than that by the puller 1. This causes the second fabric feeding mechanism 5 to catch a greater amount of the fabric 16, thereby shifting the fabric edge 17 leftward.

When the fabric edge 17 no longer covers the photosensor right 15*b*, that is, when the fabric edge 17 in between the photosensor left 15*a* and the photosensor right 15*b*, the step motor 10 is stopped so as to stop discending the driven roller 5*b*, and the present condition is maintained (S10). The the process then returns to step 4.

When the presser foot is determined to be ascending by checking the ascent of the holder 12 in step 4, then whether or not the sewing operation has finished is judged (S11). When the sewing operation has finished, the process ends, and, when not finished, the process returns to step 1.

In the embodiment shown, the fabric feeding mechanism is constructed of the lower roller 1*b* rotated by following the rotation of the upper roller 1*a* which is coupled to the sewing machine through the mechanical clutch. However, the structure of the fabric feeding mechanism is not restricted to this embodiment, and the fabric feeding mechanism may, for example, be constructed of the upper roller 1*a* driven by its own motor, or the upper roller 1*a* may be rotated by following the rotation of the lower roller 1*b*. In these alternative configurations, the same result as the above-described embodiment can be achieved.

In the embodiment shown, moreover, the upper and lower rollers 1*a* and 1*b*, constituting the first fabric feeding mechanism, are toothed rollers. However, the roller are not restricted to toothed rollers, but any fabric feeding mechanism may be applicable which can feed the fabric by a distance equivalent to the regular feeding distance by the driving roller 5*a* and driven roller 5*b*.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the metes and bounds of the claims, or equivalence of such metes and bounds thereof, are therefore intended to be embraced by the appended claims.

What is claimed is:

1. An apparatus for controlling an edge position of a fabric fed to a needle location of a sewing machine to form a seam at a constant distance from the fabric edge comprising:

a first feeding mechanism for feeding said fabric in a feeding direction;

a second feeding mechanism for feeding said fabric in said feeding direction, said second feeding mechanism being disposed at a position inward of the fabric, said first feeding mechanism and said second feeding mechanism extending lengthwise in a direction substantially perpendicular to the fabric feeding direction;

a detecting mechanism for detecting the fabric edge position in the vicinity of the needle location;

means for varying a feeding velocity of said fabric by said second feeding mechanism with respect to a feeding velocity of said first feeding mechanism, said means for varying a feeding velocity being in accordance with the detected fabric edge position;

said second feeding mechanism comprising a pair of toothed rollers, engaging depth adjusting means for adjusting a depth of tooth engagement between respective teeth on said pair of toothed rollers, and the fabric feeding velocity of said second feeding mechanism with respect to said first feeding mechanism is varied by adjusting the engaging depth of said toothed rollers; and the fabric edge position, in the vicinity of the needle position, being shifted in a direction substantially perpendicular to the fabric feeding direction whereby a seam is formed at a substantially constant distance from the fabric edge.

2. An apparatus for controlling an edge position of a fabric according to claim 1, wherein said second feeding mechanism is connected to said first feeding mechanism, and feeds the fabric in synchronism with the feeding of the fabric by said first feeding mechanism.

3. An apparatus for controlling an edge position of a fabric according to claim 1, wherein said first feeding mechanism is connected to a fabric feeding mechanism of the sewing machine, and feeds the fabric in synchronism with the feed of the fabric by said fabric feeding mechanism of the sewing machine.

4. An apparatus for controlling an edge position of a fabric according to claim 1, wherein said first feeding mechanism is connected to its own motor, thereby feeding the fabric by the actuation of said motor.

5. An apparatus for controlling an edge position of a fabric according to claim 1, wherein said detecting mechanism includes a pair of photosensors which are arranged along a direction substantially perpendicular to said fabric feeding direction and are substantially symmetrical with respect to the proper fabric edge position.

* * * * *